United States Patent [19]

Bidoia

[11] Patent Number: 5,001,849

[45] Date of Patent: Mar. 26, 1991

[54] SKI BOOT

[75] Inventor: Vincenzo Bidoia, Castelfranco V., Italy

[73] Assignee: Lange International S.A., Fribourg, Switzerland

[21] Appl. No.: 431,023

[22] Filed: Nov. 2, 1989

[30] Foreign Application Priority Data

Dec. 19, 1988 [CH] Switzerland ..... 4679/88

[51] Int. Cl.[5] ..... A43B 5/04

[52] U.S. Cl. ..... 36/117; 36/120

[58] Field of Search ..... 36/117, 118, 119, 120, 36/121, 131

[56] References Cited

U.S. PATENT DOCUMENTS

D. 271,441 11/1983 Salomon et al. ..... 36/117 X 4,711,042 12/1987 Morell et al. ..... 36/117 X

FOREIGN PATENT DOCUMENTS 0120267 10/1984 European Pat. Off. ..... 36/117

2585930 2/1987 France ..... 36/117

*Primary Examiner*—Paul T. Sewell

*Assistant Examiner*—BethAnne C. Cicconi

*Attorney, Agent, or Firm*—Kane, Dalsimer, Sullivan, Kurucz, Levy, Eisele and Richard

[57] ABSTRACT

The boot comprises a shaft (6) which is articulated on the shell and the lower edge of which is elbowed towards the interior, this elbowed part having a gap located below and opposite a stop which is integral with the shell. This gap can be closed at will by means of a movable sealing piece (21) which allows or does not allow the shaft to swivel forwards on account of the stop. This makes it possible to modify the action of the boot when bending.

4 Claims, 2 Drawing Sheets

SKI BOOT

FIELD OF THE INVENTION

The subject of the present invention is a ski boot which consists of a rigid lower part, which surrounds the foot and the heel, and a shaft which is articulated on this lower part, and of which the said lower part is provided at the rear with a projection which constitutes a stop for a locking element intended to lock the shaft in a forward position.

PRIOR ART

Such a boot is described in the document EP-A 0 086 908. In this boot the locking element is constituted by a rocker which is articulated about a horizontal pin in a cut-out in the back of the shaft and the lower end of which abuts, in the locked position, against the stop. Moreover, the shafts of ski boots have a more or less large flexibility. This natural flexibility of the boot is not always adapted to the skier, to his technique or to his style of skiing. It is thus desirable to be able to modify as required the flexibility of the boot. In the boots which are known as rear-entry boots, that is to say those boots of which the shaft consists of a front part and a rear part, both articulated, it is known to provide means for modifying the flexibility of the shaft. These means are generally adjustable stops which are positioned at the front and interact with the rear part of the shaft. On the other hand, in the case of those boots of which the shaft is in one piece, in the form of a collar, as is the case with the boot described in the document EP-A 0 086 908, it is difficult to provide means for modification of the flexibility which are placed at the front. The same problem exists for the boot described in the document EP-A 0 286 586, the shaft of which consists of an upper part in the form of a collar and a lower part in the form of an articulated cover connected to the upper part.

The object of the present invention is to provide a boot of the type described above with means, which are as simple as possible, allowing the flexibility of the boot to be modified. To this end, the invention makes use of the existing stop.

SUMMARY OF THE INVENTION

The boot according to the invention is characterized by the fact that the lower edge of the back of the shaft is elbowed in the direction of the lower part of the boot, below the stop, and that this elbowed edge has opposite the stop a gap which has a length greater than the width of the stop, and can be closed at will by means of a sealing piece mounted slidably on the elbowed edge of the shaft.

When the gap is closed by the sealing piece, the latter abuts against the lower face of the stop when the shaft has a tendency to swivel forwards. As the shaft can no longer swivel about its articulation, the flexibility of the boot is greatly reduced. On the other hand, when the gap is open, the stop can pass freely through this gap in such a manner that the shaft can swivel forwards about its articulation, the boot in this case having great flexibility.

This construction can easily be applied to the boot described in the document EP-A 0 286 586 by replacing the projection 28, against which the rocker abuts, with a projecting stop consisting of a piece which is separate or not.

Generally, the invention is applicable to all boots with an articulated shaft, in particular to a boot such as that described in the document FR-A 2 428 413, the rear part of the shaft of which is provided with a support element which can be placed in a position such that the shaft of the boot is locked in the forward position.

BRIEF DESCRIPTION OF THE DRAWING

The drawing represents, by way of example, an embodiment of the invention.

DESCRIPTION OF THE PREFERRED EMBODIMENT

Figure 1:
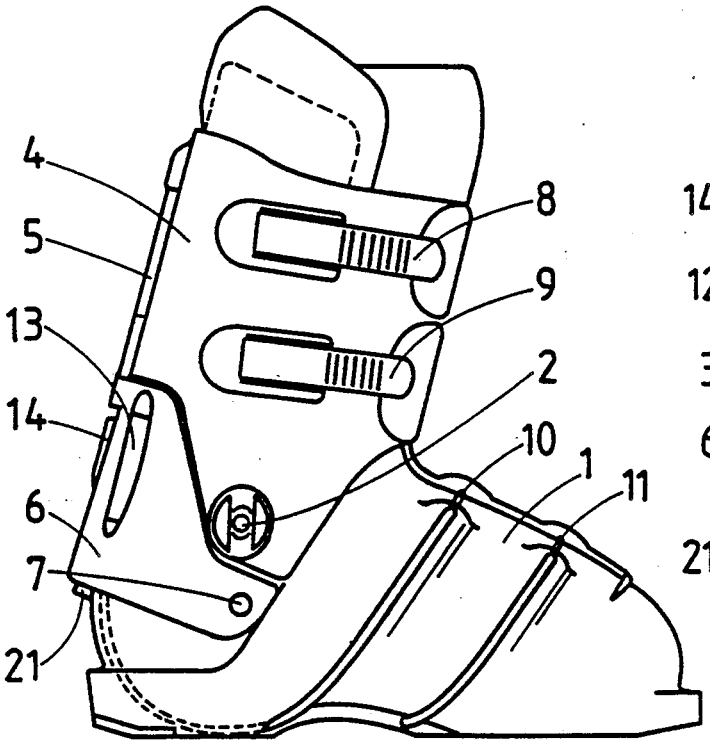
FIG. 1 is a side view of the boot.
Figure 2:
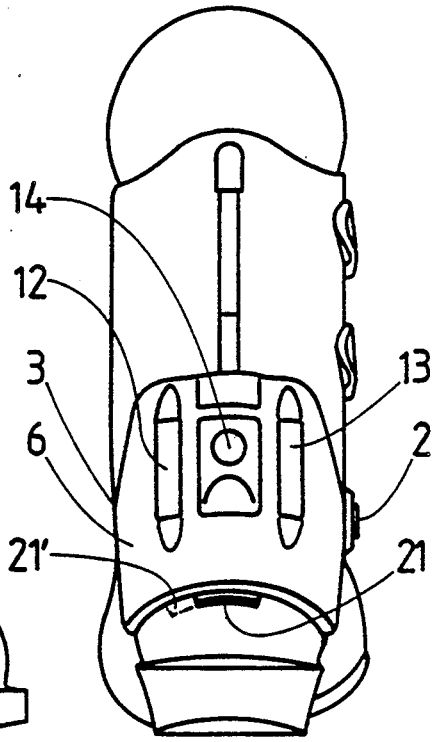
FIG. 2 is a back view of the same boot.
Figure 3:
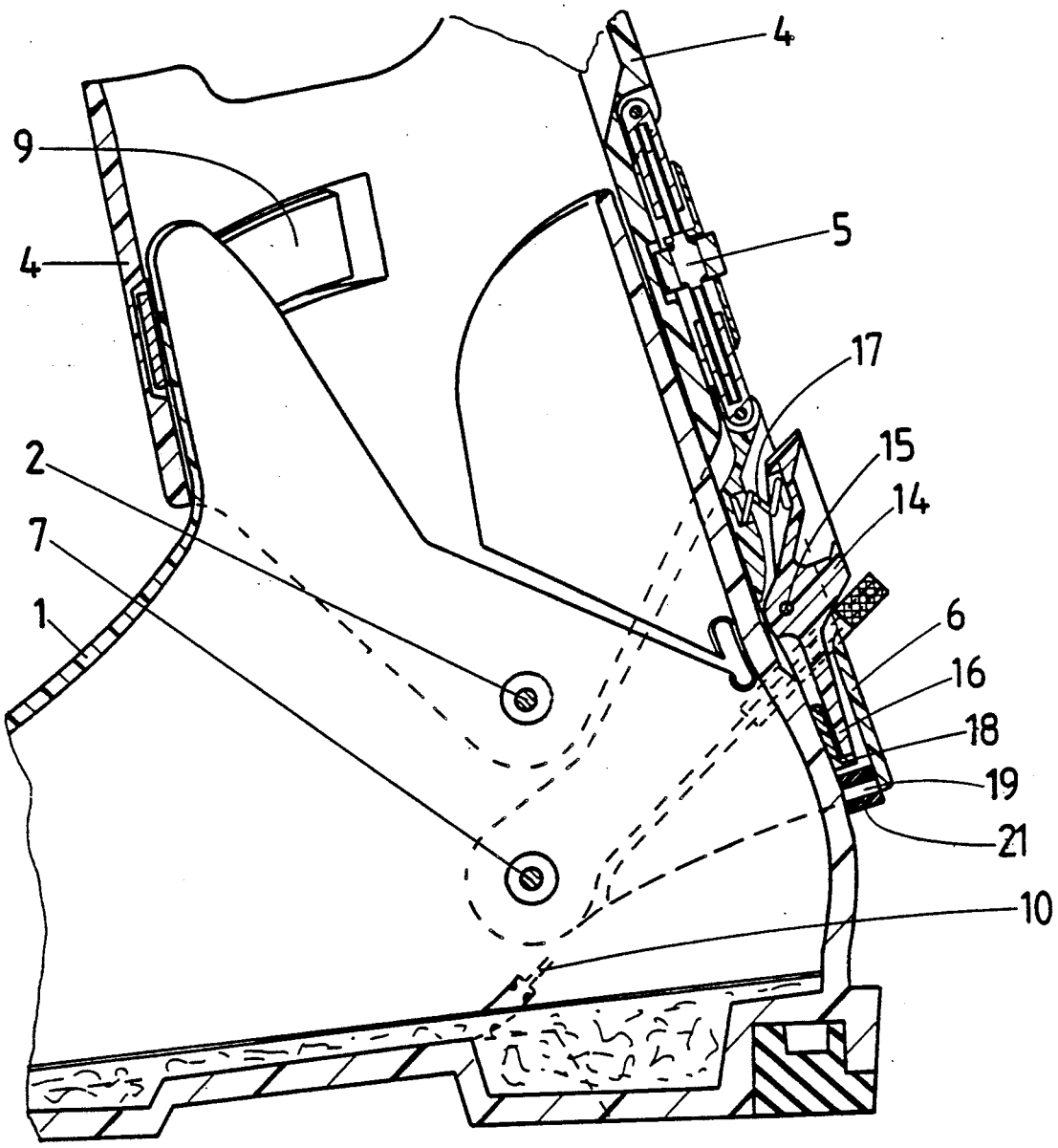
FIG. 3 is a view in vertical longitudinal cross-section of this boot.

The boot represented in FIGS. 1 to 3 corresponds in terms of the majority of these characteristics to the boot described in the document EP-A 0 286 586. The description of the latter will thus be kept brief.

The boot shown comprises a lower shell part 1, of variable volume, on which is articulated in two opposite places 2 and 3 a shaft which consists of a collar 4 connected by a link bar 5 to a swiveling cover 6 articulated at 7 below the collar 4. The swiveling cover 6 can be considered part of the shaft of the boot. The collar 4 is provided with two closing and tightening buckles 8 and 9. The shell 1 is tightened by means of two cables 10 and 11, one end of which is connected to the swiveling cover 6 by means of two adjustable cable heads 12 and 13.

The rear swiveling cover 6 is provided with a rocker 14 which is articulated about a horizontal pin 15 (FIG. 3). This rocker 14 has an arm 16 which is directed downwards and held resting against the shell 1 by means of a spring 17 which acts upon the other arm of the rocker 14. After insertion of the foot, closure of the shaft and bending of the leg, the lower arm 16 of the rocker 14 is automatically positioned above a stop 18 which consists of an elbowed metal piece fixed on the shell 1. In this position, which is shown in FIG. 3, the shaft is locked in the forward position.

Figure 4:
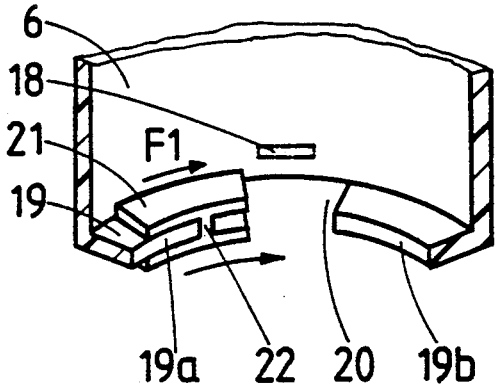
FIG. 4 is a view, from the inside, of the rear lower part of the shaft in the position of great flexibility.

The lower edge of the cover 6 has an elbow 19 in the direction of the shell 1. However, this elbow 19 has a gap 20 below the stop 18, the length of the gap 20 being greater than the width of the stop 18, as is shown in FIG. 4. On the elbowed part 19, on one side of the gap 20, a sliding piece 21 made from synthetic material and with an H-shaped profile is mounted, the two parallel parts of which engage above and below the elbowed piece 19. The bar 22 of the H forms a stop limiting the travel of the sliding piece. The H-shaped profile is asymmetrical to make possible the opening and the closing of the gap 20 and this gap extends further on the side of the longer arms of the H-shaped profile in order to form the space necessary for the sealing piece.

In the position shown in FIG. 4, the sealing piece 21 abuts against the end of the segment **19*a* of the elbowed part 19 and the gap 20 is sufficiently open to allow the stop 18 to pass through. In this position the shaft of the boot can thus swivel forwards without encountering the stop 18**. The boot thus has great flexibility.

Figure 5:
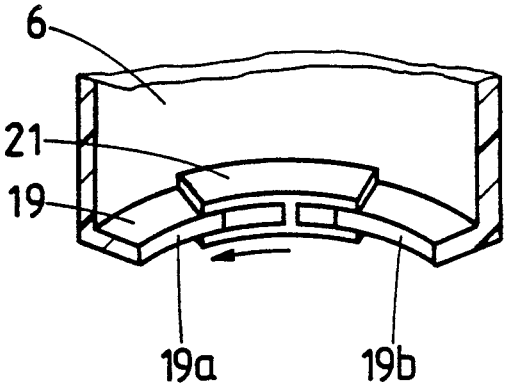
FIG. 5 is a similar view to that in FIG. 4 but in the position of reduced flexibility.

If the sliding seal 21 is then moved in the direction of the arrow F1, the gap 20 is then closed completely. The H-shaped profile is supported on the two segments 19*a* and 19*b* of the elbowed part, as shown in FIG. 5. In this position of the seal 21, the shaft of the boot abuts against the stop 18 when it has a tendency to swivel forwards. The shaft is thus practically immobilized, on the one hand by the arm 16 of the rocker 14 and on the other by the seal 21. The boot is then relatively rigid.

The position of the seal shown in FIG. 5 is shown in solid lines in FIG. 2, the position of FIG. 4 being represented in dot-dash lines at 21'.

The seal 21 could be executed in a different manner to that shown in the drawing. It could, for example, consist of a bar sliding in a transverse hole in the bottom of the shaft. Instead of being sliding, the seal could be formed by a piece articulated about a horizontal pin or parallel to the leg.

The sliding seal 21 can be provided with an operating button and notched or other positioning means.

I claim:

1. A ski boot comprised of a rigid lower part (1), which surrounds the foot and the heel, and a shaft (4, 6) which is articulated on this lower part, the lower part being provided at the rear with a stop having a width dimension (18) which constitutes a stop for a locking element (14) intended to lock the shaft in a forward position, the back of the shaft having a lower edge that is elbowed (19) in the direction of the lower part of the boot and is positioned below the stop (18), and wherein this elbowed edge (19) has opposite the stop a gap (20) having opposite ends, the gap having a length greater than the width of the stop, and can be selectively closed by means of a movable sealing piece (21) that is engaged with the elbowed edge.

2. The ski boot as claimed in claim 1, wherein the movable sealing piece (21) is mounted slidably on the elbowed edge (19) of the shaft.

3. The ski boot as claimed in claim 2, wherein the sealing piece (21) consists of a curved piece with an H-shaped profile which has arms, the arms of which extend over and under the elbowed part of the lower edge of the shaft of the boot in a position which seals the gap, the length of the gap being such that the gap creates an open space when the sealing piece abuts against one of the ends of the gap and is sufficient to allow the said stop (18) to pass through.

4. The ski boot as claimed in claim 3, wherein the sealing piece (21) is asymmetrical and wherein the said gap (20) extends further on the side of the longer arms of the H-shaped profile in order to form the space necessary for the sealing piece.

* * * * *